US005305504A

United States Patent [19]

Manly, Jr.

[11] Patent Number: 5,305,504

[45] Date of Patent: Apr. 26, 1994

[54] METHOD AND APPARATUS FOR FORMING A SCRIM WITH YARNS ORIENTED IN THE BIAS DIRECTION

[75] Inventor: John B. Manly, Jr., Moore, S.C.

[73] Assignee: Milliken Research Corporation, Spartanburg, S.C.

[21] Appl. No.: 5,763

[22] Filed: Jan. 15, 1993

[51] Int. Cl.[5] ..... D04H 3/04; D02G 3/36

[52] U.S. Cl. ..... 28/102; 57/6; 156/436

[58] Field of Search ..... 87/1, 13, 23, 31, 34, 87/44, 47, 62; 28/101, 102; 156/436, 440, 446, 447, 443; 57/3, 6, 7, 10

[56] References Cited

U.S. PATENT DOCUMENTS

| | | | |
|---|---|---|---|
| 1,951,301 | 3/1934 | Angier et al. . | |
| 2,772,718 | 12/1956 | Magnuson . | |
| 3,000,432 | 9/1961 | Olken . | |
| 3,332,822 | 7/1967 | Van Ness | 156/436 |
| 3,345,231 | 10/1967 | Gidge et al. | 28/102 X |
| 3,459,615 | 8/1969 | Ellerman | 156/181 |
| 3,493,455 | 3/1970 | LeBolt et al. | 28/101 X |
| 3,602,965 | 9/1971 | Burger | 28/101 |
| 3,728,195 | 4/1973 | Bolles | 156/441 |
| 3,756,893 | 9/1973 | Smith | 156/436 X |
| 3,880,696 | 4/1975 | Chen | 28/101 X |
| 3,961,265 | 11/1975 | Eschenbach | 28/101 |
| 4,617,789 | 10/1986 | Borden | 57/6 |
| 4,635,430 | 1/1987 | Missout et al. | 57/6 |

FOREIGN PATENT DOCUMENTS

| | | | |
|---|---|---|---|
| 627062 | 9/1961 | Canada | 28/101 |
| 1635610 | 8/1969 | Fed. Rep. of Germany | 352/28 |
| 4023558 | 2/1991 | Fed. Rep. of Germany | 28/102 |
| 1481298 | 5/1989 | U.S.S.R. | 28/101 |
| 446049 | 4/1936 | United Kingdom . | |

*Primary Examiner*—Clifford D. Crowder
*Assistant Examiner*—John J. Calvert
*Attorney, Agent, or Firm*—Kevin M. Kercher; Terry T. Moyer

[57] ABSTRACT

A method and apparatus for forming a scrim with fibers oriented in the bias direction comprising of at least two belts and at least one plate which forms a three dimensional mandrel over which the bias scrim is formed. The plate is shaped so that any cross-section taken perpendicularly to the direction of travel of the scrim, the perimeter of the scrim formed by fibers wrapped around the machine in the plane of the cross-section is constant. This constant is equal to twice the final width of the scrim from selvedge to selvedge. The scrim is formed by wrapping fibers around the front of the assembly while the belts move toward the rear end of the machine. The movement of the belts carry the fibers to the rear of the assembly as they are wrapped around the assembly. The belts travel at substantially the same speed in opposite directions. The ratio of the speed that the fibers are wrapped around the assembly and the speed of the belts determine the fiber angle of the bias scrim. This fiber angle can be varied continuously from transverse to nearly longitudinal. The bias angle can be varied while the assembly is operating.

35 Claims, 7 Drawing Sheets

METHOD AND APPARATUS FOR FORMING A SCRIM WITH YARNS ORIENTED IN THE BIAS DIRECTION

BACKGROUND OF THE INVENTION

This invention relates to an improved method and apparatus for forming a scrim with fibers oriented in the bias direction.

A scrim is defined as a fabric with an open construction used as a base fabric in the production of coated or laminated fabrics. Previously, machines utilized to form a scrim use a chain in which the fibers are passed through the links on the chain. This restricts the number of fibers to an even multiple to the number of links on the chain. Changing the number of fibers used requires adding or removing chain links and other adjustments for proper operation.

In addition, the previous machines utilized for forming a scrim require a chain to rotate with the creel. The linear velocity of the chain could become excessively large if the fibers in the scrim are nearly transverse.

Another major drawback to the previous machines utilized for forming a scrim is that when using a chain, there is a minimum limit to the number of chain links needed to form a continuous loop of chain as well as the length of each chain length is also constricted by a minimum value. As the length of chain is decreased, the chordal action of the chain around the respective sockets becomes more pronounced. The variation in velocity brought about by the chordal action of the chain can cause slack regions within the scrim.

The present invention solves the above problems in a manner not disclosed in the known prior art.

SUMMARY OF THE INVENTION

A method and apparatus for forming a scrim with fibers oriented in the bias direction comprising of at least two belts and at least one plate which forms a three dimensional mandrel over which the bias scrim is formed. The plate is shaped so that any cross-section taken perpendicularly to the direction of travel of the scrim, the perimeter of the scrim formed by fibers wrapped around the machine in the plane of the cross-section is constant. This constant is equal to twice the final width of the scrim from selvedge to selvedge. The scrim is formed by wrapping fibers around the front of the assembly while the belts move toward the rear end of the machine. The movement of the belts carries the fibers to the rear of the assembly as they are wrapped around the assembly. The belts travel at substantially the same speed in opposite directions. The ratio of the speed that the fibers are wrapped around the assembly and the speed of the belts determines the fiber angle of the bias scrim. This fiber angle can be varied continuously from transverse to nearly longitudinal. The bias angle can be varied while the assembly is operating.

An advantage of this invention is that any number of fibers may be used to make a scrim with nearly any bias angle without any modification of the assembly.

It is another advantage of this invention to be able to change the number of fibers by merely adding spools or bobbins to a rotating creel.

Yet another advantage of this invention is to be able to change the bias angle merely by changing the rotation of the creel and the speed of the belts.

Still another advantage of this invention is that the number of fibers utilized in the scrim can be changed without removing chain links or other complicated adjustments.

Another advantage of this invention is that this assembly can be operated at very high speed that can be substantially the same speed as the web speed.

Yet another advantage of this invention is that very narrow scrims can be created with the minimum size of the scrims limited to the thickness of the belts.

In another aspect of this invention is that slack regions around the scrim can be eliminated.

These and other advantages will be in part obvious and in part pointed out below.

BRIEF DESCRIPTION OF THE DRAWINGS

The above as well as other objects of the invention will become more apparent from the following detailed description of the preferred embodiments of the invention, which when taken together with the accompanying drawings, in which.

Corresponding reference characters indicate corresponding parts throughout the several views of the drawings.

DETAILED DESCRIPTION OF THE PREFERRED EMBODIMENT

Figure 1:
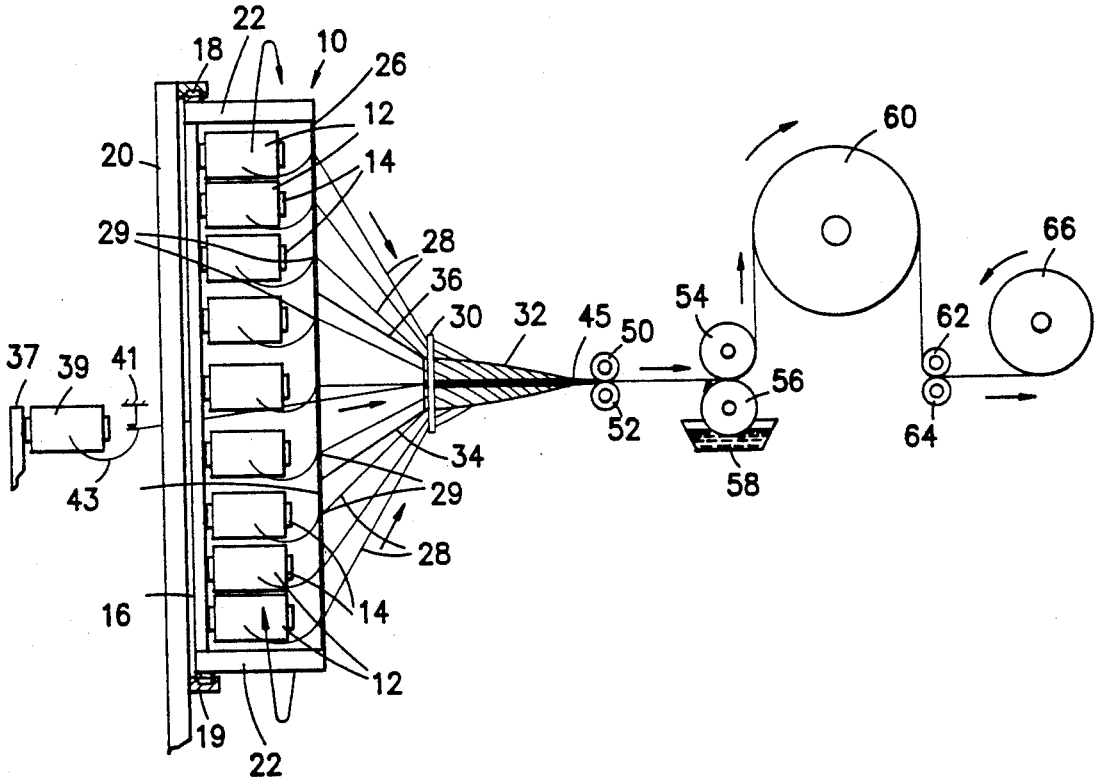
FIG. 1 is a schematic side elevational view of the apparatus constructed according to the present invention including creel take-off, adhesive application, drying and take-up.

Referring now by reference numerals to the drawings, and first to FIG. 1, a creel is generally indicated by numeral 10. The creel 10 is comprised of preferably at least nine yarn packages 12 with the number of yarn packages 12 varying greatly depending on scrim construction. The yarn packages 12 are positioned on stationary shafts 14 that are attached to the back support member 16 that is attached to a circular support plate 22. There is also a vertical front plate 26 attached to the circular support plate 22. This vertical front plate 26 has openings 29 that guide yarns 28 from the yarn packages 12 and through a circular creel ring 30 and then onto the scrim forming apparatus that is generally denoted by numeral 32. The circular creel ring 30 is attached to the vertical front plate 26 by means of upper and lower support members 36 and 34, respectively.

Figure 2:
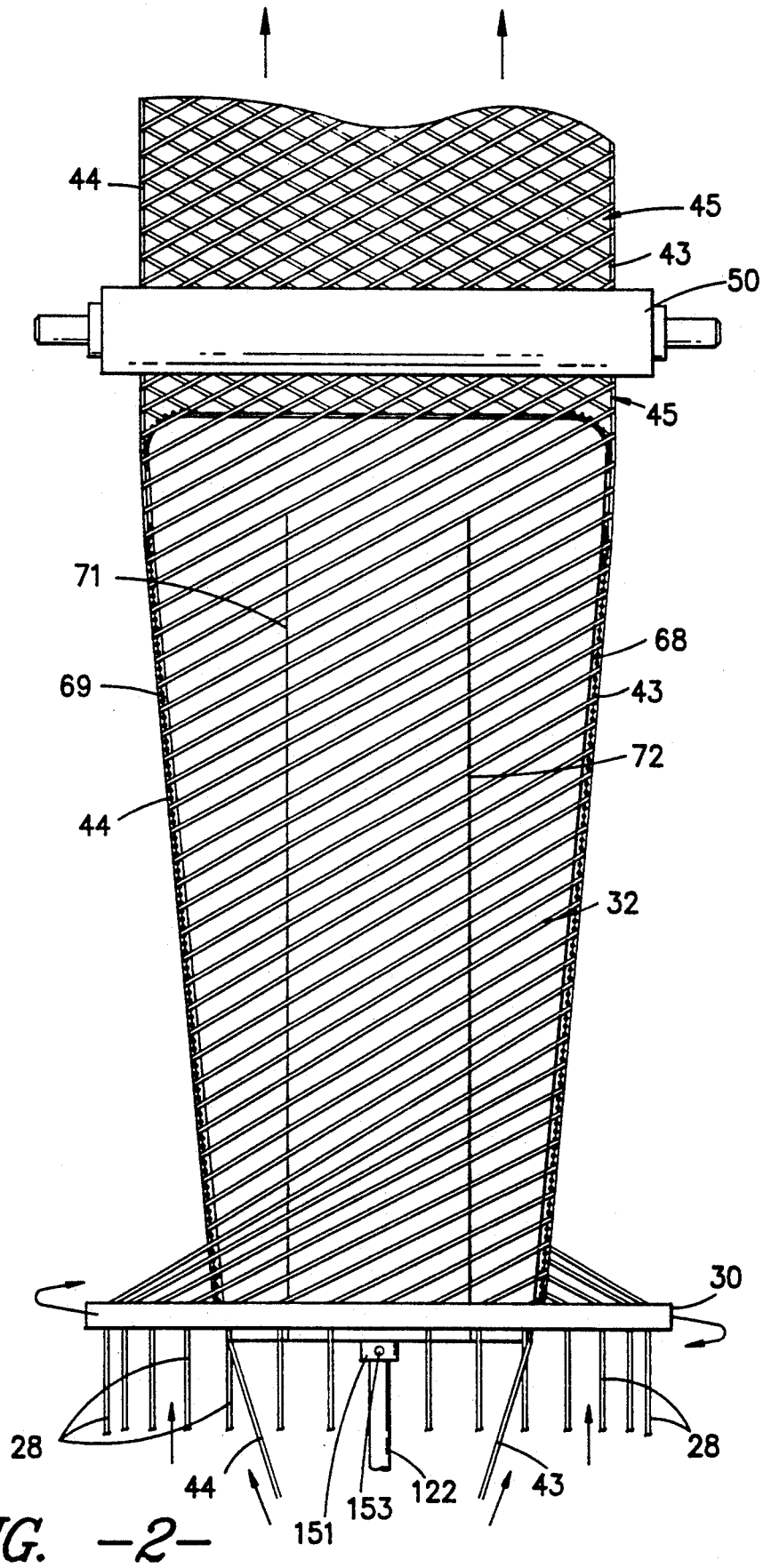
FIG. 2 is a top plan view of the apparatus constructed according to the present invention with rotating creel assembly and opposed compression rolls.

The creel 10 rotates by means of an upper support bearing 18 and a lower support bearing 19 that are attached to the main vertical creel support member 20. There must be at least three support bearings even though only two are shown in FIG. 1. There are also two ancillary yarn packages 39, with only one being shown in FIG. 1, attached to a support 37. A support and guide means for yarn 43 is designated by numeral 41. The two yarns 43 and 44 associated with ancillary yarn packages 39, as best shown in FIG. 2, form the selvedge for the formed scrim that is designated by numeral 45. After the scrim 45 is formed by the scrim forming apparatus 32, which will be disclosed in greater detail hereinafter, the scrim 45 then is compressed by means of both an upper compression roll 50 and a lower compression roll 52, as shown in FIG. 1. The scrim 45 is then padded with an adhesive by means of upper padding roll 54 and lower padding roll 56. The lower padding roll 56 is submerged in a tray of adhesive 58. A wide variety of adhesives will suffice such as polyvinyl alcohol, polyvinyl chloride, among others. The formed scrim 45 then travels over a steam can 60 to dry the adhesive at a temperature in the range of 200 to 350 degrees Fahrenheit and then through upper and lower drive rolls 62 and 64, respectively and then onto take-up roll 66.

Figure 3:
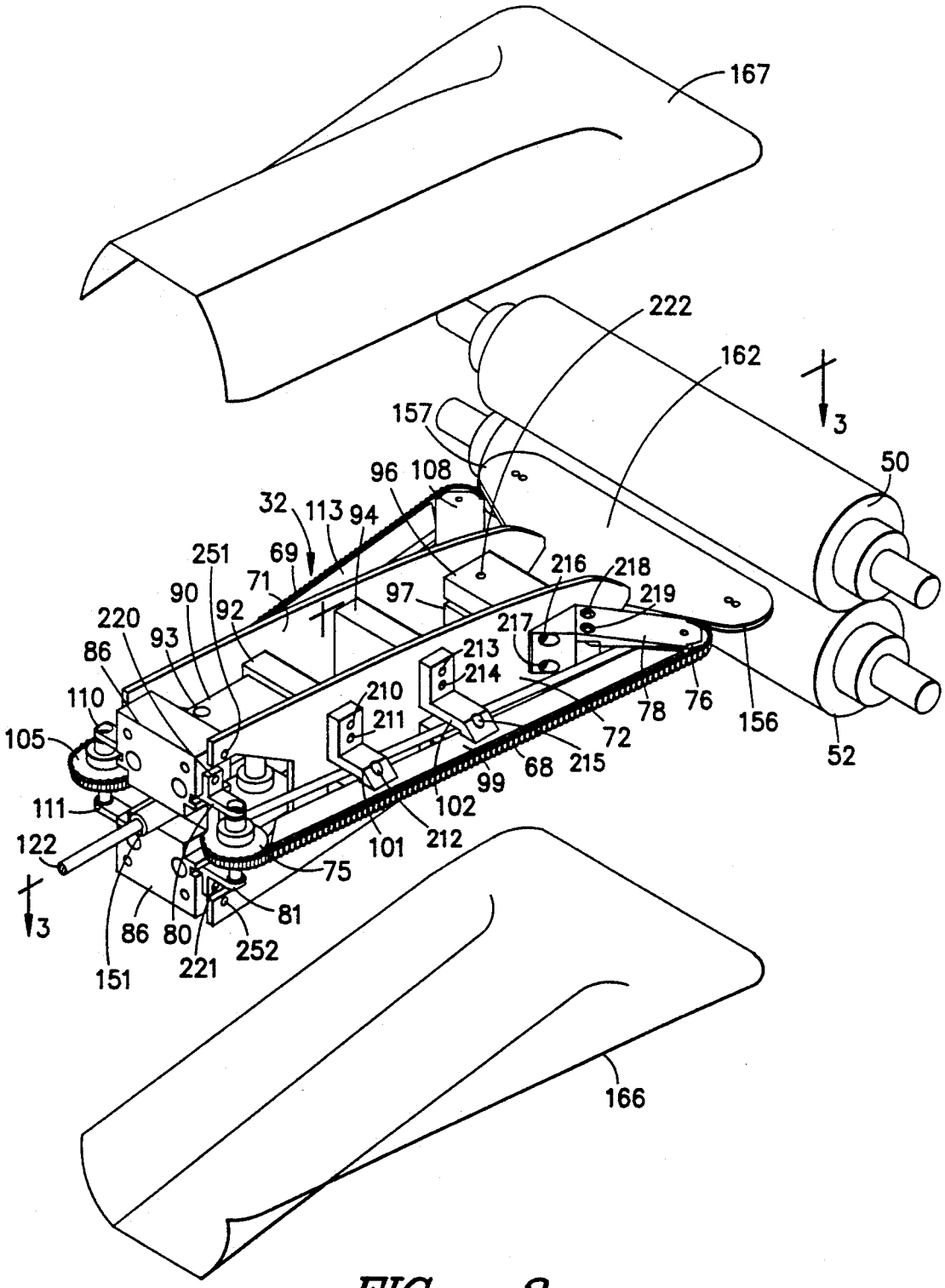
FIG. 3 is a right side perspective view of the apparatus constructed according to the present invention including top and bottom covers and opposed compression rolls.
Figure 4:
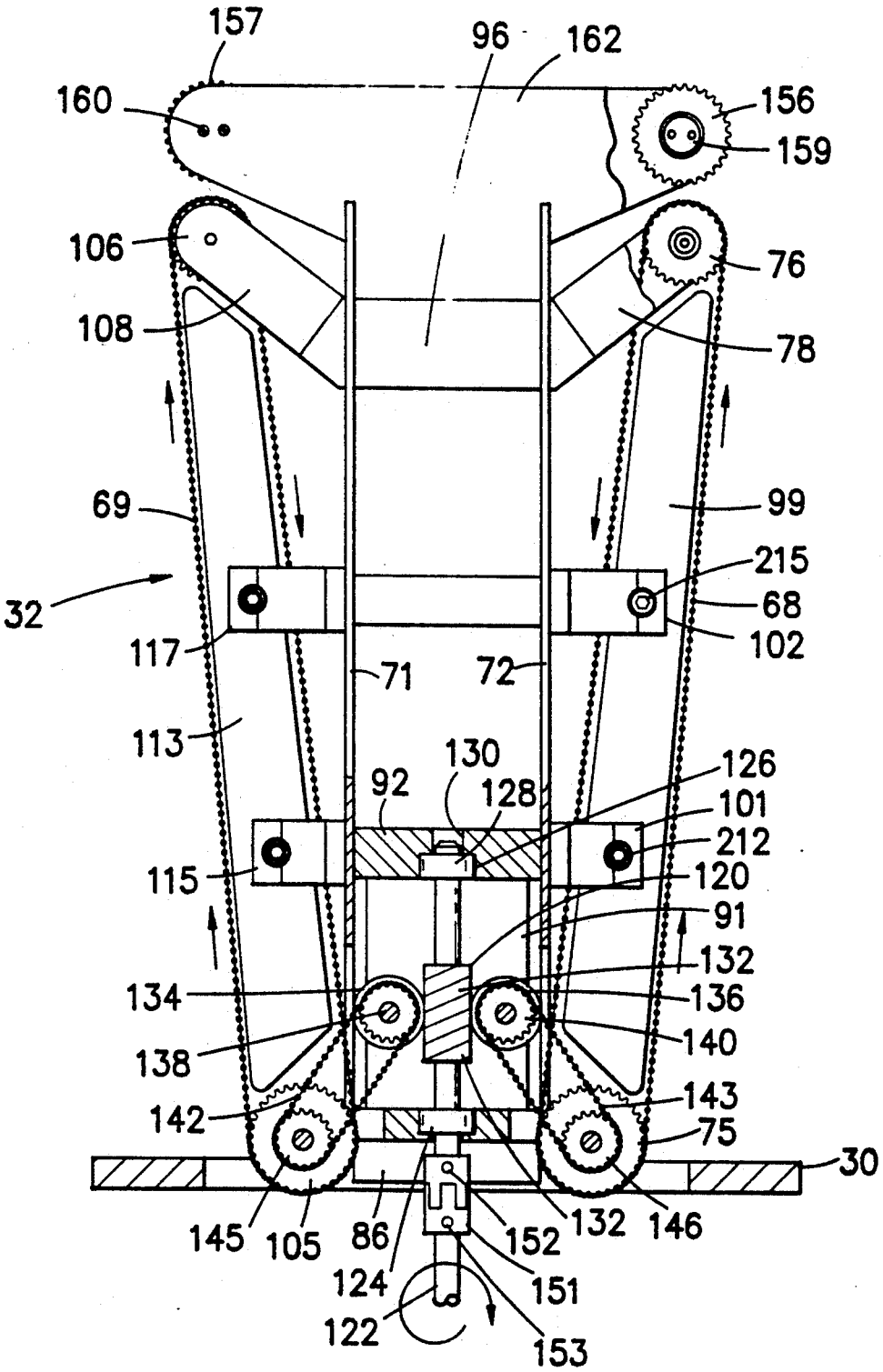
FIG. 4 is a cross-sectional view taken on Line 3—3 of FIG. 3.

The scrim forming apparatus 32 is further detailed in FIGS. 2, 3 and 4. The primary operating mechanism comprises of a first endless belt 68 and a second endless belt 69 that rotate at relatively the same speed and in opposite directions for guiding the yarns as well as at least one plate for forming a three-dimensional mandrel over which the bias scrim is formed. In FIGS. 2–5, the first endless belt 68 is located on the right and the second endless belt 69 is located on the left. In the preferred embodiment, there should be both a first plate and a second plate, designed on the left by numeral 71 and on the right by numeral 72, respectively, as shown in FIG. 3. The first plate 71 and second plate 72 are shaped so that at any cross section taken perpendicular to the direction of travel of the scrim 45, the perimeter formed by a yarn 28 wrapped around the scrim-forming apparatus 32 in the plane of the cross-section is a constant equal to twice the final width of the scrim 45, from selvedge yarn 43 to selvedge yarn 44. The purpose of maintaining a constant perimeter for the length of the machine is to prevent any of the yarns 28 forming the scrim 45 from becoming slack or excessively taut.

The scrim 45 is formed by the yarns 28 dispensed from the circular creel ring 30 that maintains tension on the yarns 28 and wraps the yarns 28 around the front of the scrim forming apparatus 32. The movement of first endless belt 68 and second endless belt 69 carries the yarns 28 toward the rear of the scrim forming apparatus 32 as the yarns 28 are wrapped around the scrim forming apparatus 32.

Referring now to FIGS. 3 and 4, there is a first sprocket 75 and a second sprocket 76 associated with the first endless belt 68. Second sprocket 76 is attached to second plate 72 by means of a combination bracket and sprocket assembly 78. There are two hexagonal cap screws 216 and 217 that attach the bracket to the second plate 72 by means of threaded attachment to lower rear plate assemblies 96 and 97, respectively. There are two hexagonal cap screws 218 and 219 that attach the bracket to the sprocket assembly. All components utilized throughout this Application are preferably formed of aluminum, however, a wide variety of metals, plastics, composites, and so forth will suffice. Attachment is preferably accomplished by means of hexagonal cap screws, however, a wide variety of attachment means will suffice including mechanical means, adhesives, welding, brazing, and so forth. There is a top sprocket bracket assembly 80 and a bottom sprocket bracket assembly 81 that attach to first sprocket 75. Top sprocket bracket assembly 80 attaches to a front block 86, which is located between second plate 72 and first plate 71, by hexagonal cap screw 220. Bottom sprocket bracket assembly 81 also attaches, by hexagonal cap screw 221, to front block 86. Front block 86 is located between second plate 72 and first plate 71 and attached thereto as shown on the right side by hexagonal cap screws 251 and 252, respectively. Additional support members located between second plate 72 and first plate 71 include front upper plate assembly 90 and corresponding front lower plate assembly 91, as shown in FIG. 4. Additional support members located between first plate 71 and second plate 72 and are attached thereto include a front middle member 92, a rear middle member 94 and an upper and lower rear plate assemblies 96 and 97, respectively. Front upper plate assembly 90 and corresponding front lower plate assembly 91 are attached to front middle member 92 and front spacer block 86 by means of hexagonal cap screws (not shown). First endless belt 68 encircles a first endless belt support 99 that maintains tension in first endless belt 68 and prevents the first endless belt 68 from necking inward while preserving the shape thereof. There is a front first endless belt support bracket 101 and a rear first endless belt support bracket 102 that connects the first endless belt support 99 to second plate 72. This is accomplished in the first leg of the front first endless belt support bracket 101 by means of hexagonal cap screws 210 and 211 through second plate 72 and threadedly attached to front middle member 92. The second leg of the front first endless belt support bracket 101 is attached to the first endless belt support 99 by means of hexagonal cap screw 212. This identical arrangement is replicated with the rear first endless belt support bracket 102 with hexagonal cap screws 213 and 214 through second plate 72 and threadedly attached to rear middle member 94. The second leg of the rear first endless belt support bracket 102 is attached to the first endless belt support 99 by means of hexagonal cap screw 215.

Correspondingly, as shown in FIG. 4, there is a third sprocket 105 and a fourth sprocket 106 associated with the second endless belt 69. As shown in FIG. 3, fourth sprocket 106 is attached to first plate 71 by means of a combination bracket and sprocket assembly 108 in the same manner as combination bracket and sprocket assembly 78. Sprocket assembly 108 is attached to lower rear plate assembly 96 by means of a hexagonal cap screw (not shown) through first plate 71. There is a top sprocket bracket assembly 110 and a bottom sprocket bracket assembly 111, which both attach to third sprocket 105 in the same manner as the top and bottom sprocket bracket assembly 80 and 81, respectively. Top sprocket bracket assembly 110 attaches to front spacer block 86 that is located between first plate 71 and second plate 72. Bottom sprocket bracket assembly 111 attaches to front spacer block 86 that is located between first plate 71 and second plate 72 and attached thereto. As best illustrated in FIG. 4, second endless belt 69 encircles second endless belt support 113 that maintains tension in second endless belt 69 and prevents the second endless belt 69 from necking inward while preserving the shape thereof. There is a front second endless belt support bracket 115 and a rear second endless support bracket 117 that connect the belt support 113 to first plate 71 in the same manner as rear and front first endless belt support brackets 101 and 102, respectively. Front second endless belt support bracket 115 is attached to front middle member 92 by means of dual hexagonal cap screws (not shown) through first plate 71. Rear second endless belt support bracket 115 is attached to rear middle member 94 by means of dual hexagonal cap screws (not shown) through first plate 71.

The internal drive mechanism is generally indicated by numeral 120, as shown in FIG. 4, comprising of an input drive shaft 122 that is held in rotatable position by front bearing 124 and rear bearing 126. There is a coupling mechanism 151 that extends the input drive shaft 122 and attaches thereto by means of threaded screws 153 and 152, respectively. Front bearing 124 is held in position by front spacer block 86, as shown in FIG. 3.

As shown in FIG. 4, rear bearing 126 is held in position by first middle member 92 having an aperture 128 to accommodate the rear bearing 126 and a smaller aperture 130 to allow the input drive shaft 122 to rotate freely. Between front bearing 124 and rear bearing 126, a worm drive 132 encircles the input drive shaft 122 and is moved in fixed relation thereby. This worm drive 132 turns first worm wheel 134 clockwise and second worm wheel 136 counterclockwise. As shown in FIG.4, the first worm wheel 134 is located on the left and the second worm wheel 136 is located on the right. First worm wheel 134 is fixedly attached to first drive sprocket 138 and the second worm wheel 136 is fixedly attached to second drive sprocket 140. There is first secondary drive belt 142 that is attached to the first drive sprocket 138 and connects to a first secondary drive sprocket 145. The first secondary drive sprocket 145 is fixedly attached to third sprocket 105. Therefore, worm drive 132 rotating clockwise moves first worm wheel 134 clockwise thereby moving first drive sprocket 138 clockwise and thereby moving first secondary drive belt 142 clockwise, thereby moving first secondary drive sprocket 145 clockwise as well as third sprocket 105 which moves second endless belt 69 in a clockwise rotation thereby moving the scrim from the front to the rear of the scrim forming apparatus 32.

There is also a second secondary drive belt 143 that is attached to the second drive sprocket 140. As previously stated, the second drive sprocket 140 is fixedly attached to the second worm wheel 136. Therefore, worm drive 132 rotating clockwise moves second worm wheel 136 counterclockwise, thereby moving second drive sprocket 140 counterclockwise and thereby moving second secondary drive belt 143 counterclockwise, thereby moving second secondary drive sprocket 146 counterclockwise as well as first sprocket 75 which moves first endless belt 68 in a counterclockwise rotation thereby moving the scrim from the front to the rear of the scrim forming apparatus 32.

As shown in FIG. 3, just prior to exiting the scrim forming apparatus 32, the spread passes over a triangular scrim plate 162 that is attached between upper rear spacer block 96 and lower rear spacer block 97 by means of hexagonal cap screw 222. As shown in FIG. 4, attached to the outer opposed ends of the triangular spread plate 162 are a first gear 156 and associated first gear bearing 159 and second gear 157 and associated second gear bearing 160. The first gear 156 and second gear 160 are designed to engage the scrim 45. The scrim 45 then travels through the upper and lower compression rolls 50 and 52, respectively, as shown in FIG. 3. There is an upper cover 167 and a lower cover 166 that conform to the outside of the scrim forming apparatus 32 in order to keep the scrim 45 isolated from any outside interference or contamination.

Figure 5:
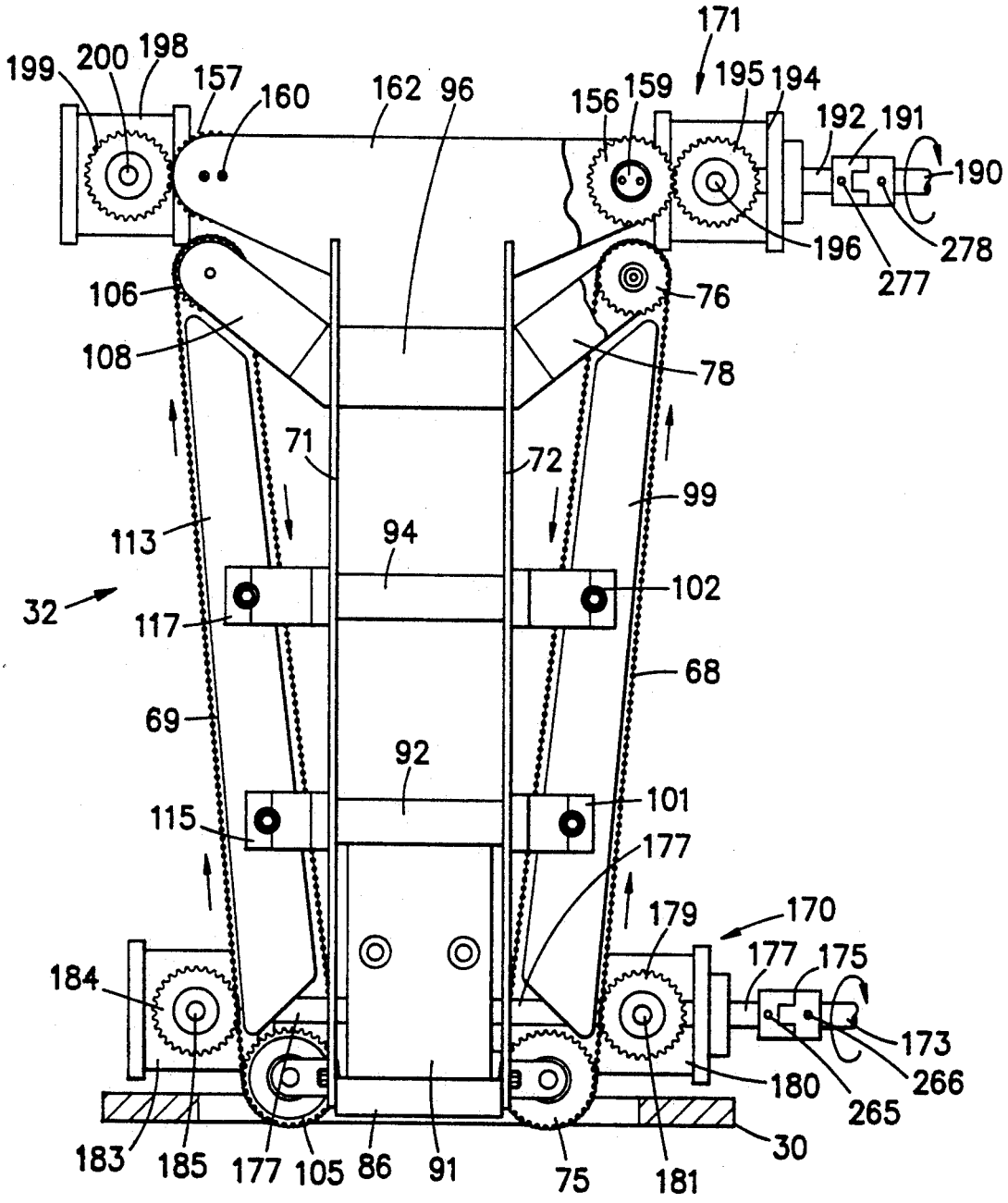
FIG. 5 is a view corresponding to FIG. 4 only utilizing an alternative embodiment as a drive mechanism for the belts.
Figure 6:
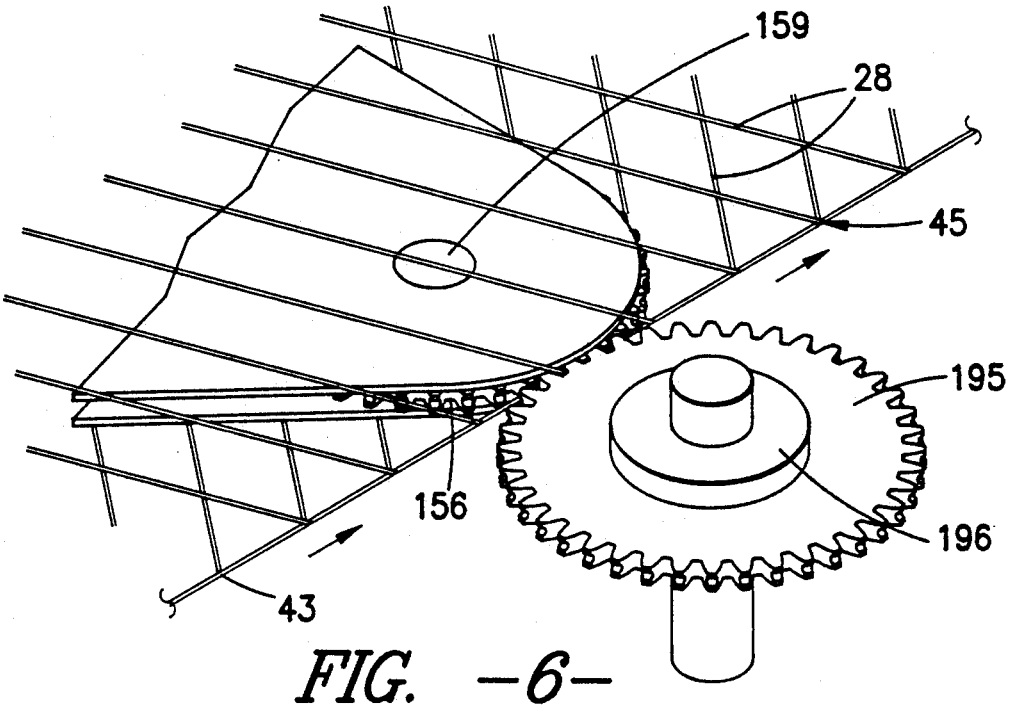
FIG. 6 is an isolate perspective view of the upper gear drive mechanism detailed in FIG. 5.
Figure 7:
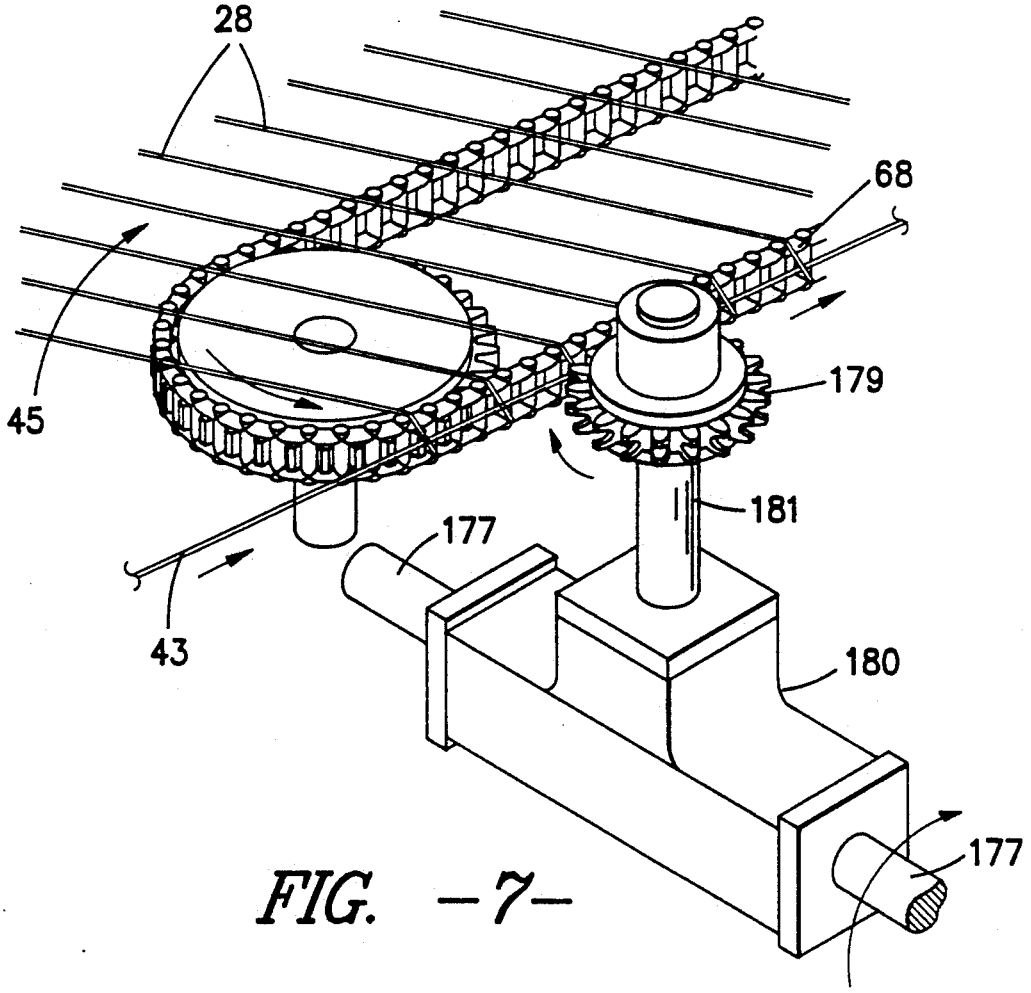
FIG. 7 is an isolated perspective view of the lower belt drive mechanism detailed in FIG. 5.

An alternative means of driving first endless belt 68 and second endless belt 69 with the internal drive mechanism 120 found at the front of the scrim forming apparatus 32, and parallel to the longitudinal axis thereof, is found in FIG. 5 and involves the replacement of the internal drive mechanism 120 with two drive units located substantially perpendicular to the longitudinal axis of the scrim forming apparatus 32. The first drive unit is located near the front of the scrim forming apparatus and generally indicated by numeral 170. There is a first input drive shaft 173 connected to a first coupling unit 175 that is attached to a first drive shaft 177 by means of hexagonal cap screws 265 and 266, respectively. The first drive shaft 177 extends on both sides of the scrim forming apparatus 32. The first drive shaft 177 passes through a first right angle drive translator 180 and is in mechanical interengagement therewith and having a first drive translator gear 179, having an associated first shaft and bearing assembly 181. The first drive translator gear 179 engages the outside of the first endless belt 68 and rotates the first endless belt 68 in a counterclockwise rotation. As shown in FIG. 7, the first drive translator gear 179 and the first endless belt 68 allow the scrim 45 to move therebetween without damage to the scrim 45. This is accomplished by means of a relief groove cut into the teeth of first drive translator gear 179 which allows passage of selvedge 43 therebetween without damage. The first drive shaft 177 also connects to a second right angle drive translator 183 and is in mechanical interengagement therewith and having a second drive translator gear 184, having an associated second shaft and bearing assembly 185. The second drive translator gear 184 engages the outside of the second endless belt 69 and rotates the second endless belt 69 in a clockwise rotation. As with the first drive translator gear 179, the second drive translator gear 184 and the second endless belt 69 allow the scrim 45 to move therebetween without damage to the scrim 45. The second drive unit is located near the rear of the scrim forming apparatus 32 and generally indicated by numeral 171. There is a second input drive shaft 190 connected to a second coupling unit 191 that is attached to a second drive shaft 192 by means of hexagonal cap screws 277 and 278, respectively. The second drive shaft 192 extends on both sides of the scrim forming apparatus 32. The second drive shaft 192 passes through a third right angle drive translator 194 and is in mechanical interengagement therewith and having a third drive translator gear 195, having an associated third shaft and bearing assembly 196, which engages the outside of first gear 156 and rotates first gear 156 in a counter-clockwise rotation. As shown in FIG. 6, the third drive translator gear 195 and first gear 156 allow the scrim to move therebetween without damage to the scrim 45. There is a small groove cut into the teeth of the third drive translator gear 195 and first gear 156 to prevent the selvedge yarn 43 from being cut up. The second drive shaft 192 also connects to a fourth right angle drive translator 198 and is in mechanical interengagement therewith and having a fourth drive translator gear 199, having an associated fourth shaft and bearing assembly 200, which engages the outer left side of second gear 157 and rotates second gear 157 in a clockwise rotation. As with the third drive translator gear 195, the fourth drive translator gear 199 and second endless belt 69 allow the scrim 45 to move therebetween without damage to the scrim 45.

With the exception of the drive means, the alternative embodiment of FIG. 5 is substantially similar to FIG. 4 with identical numerical designations to reflect such similarity. It should be noted that with both embodiments, first sprocket 75, second sprocket 76, third sprocket 105 and fourth sprocket 106 must be of the type required to engage first endless belt 68 and second endless belt 69.

Figure 8:
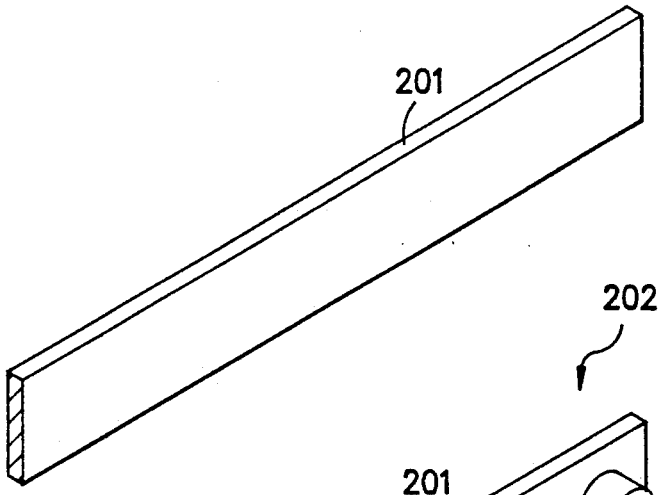
FIG. 8 is an isolated perspective view of a flat belt.
Figure 9:
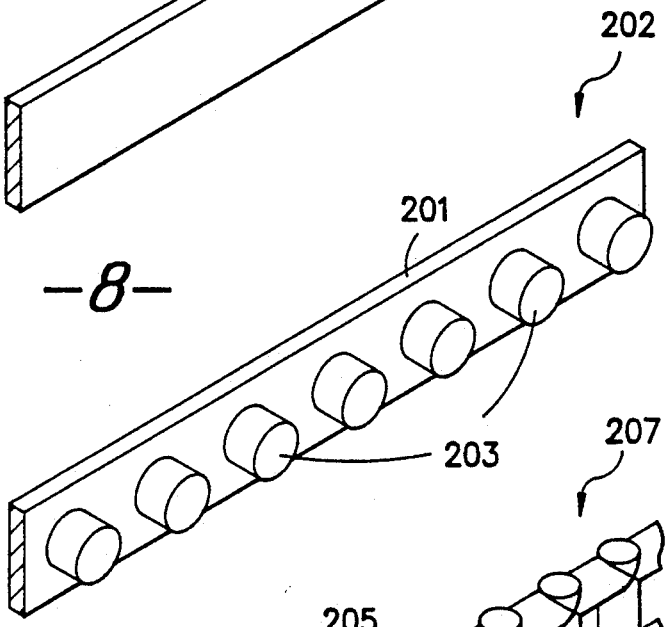
FIG. 9 is an isolated perspective view of a flat belt having cylindrical protrusions extending therefrom.
Figure 10:
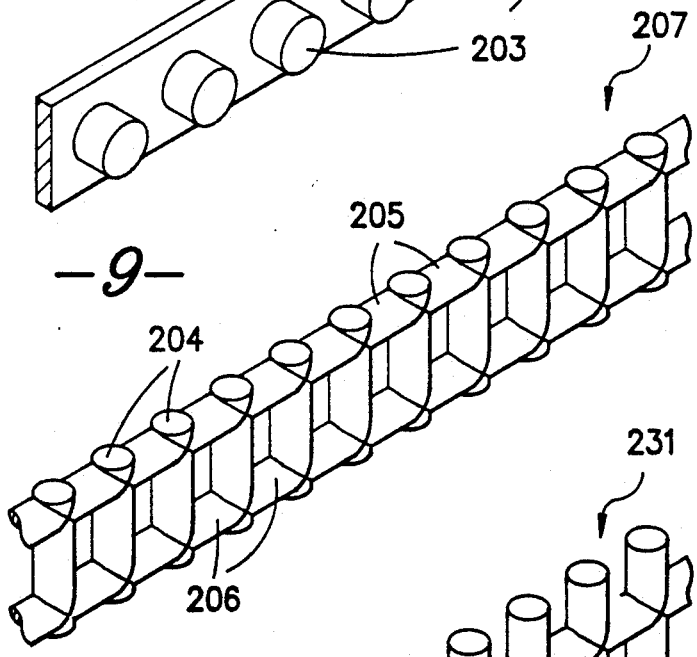
FIG. 10 is an isolated perspective view of a ladder-type chain belt.

There are several embodiments of the type of the first and second endless belts 68, 69 that could create the scrim 45 as part of the scrim forming apparatus 32. A flat belt can be utilized, as shown in FIG. 8, and designated by numeral 201. It is understood that there should be a significant degree of friction on the surface of flat belt 201 in order for belt 201 to move the scrim 45. Another embodiment is to utilize a flat belt 201 with cylindrical protrusions 203 projecting from one side, as shown in FIG. 9 and generally indicated by numeral 202. Each yarn 28 will then be separated from each other to insure high quality scrim formation.

A third embodiment of the first or second endless belt 68, 69 is to use a series of cylindrical members 204 that are perpendicularly interconnected by a series of upper linking members 205 located near the top of the cylindrical members 204 and a series of lower linking members 206 located near the bottom of the cylindrical members 204. Upper linking members 205 are in parallel relationship to lower linking members 206 and in conjunction with cylindrical members 204 form a ladder-type chain generally indicated by numeral 207.

Figure 11:
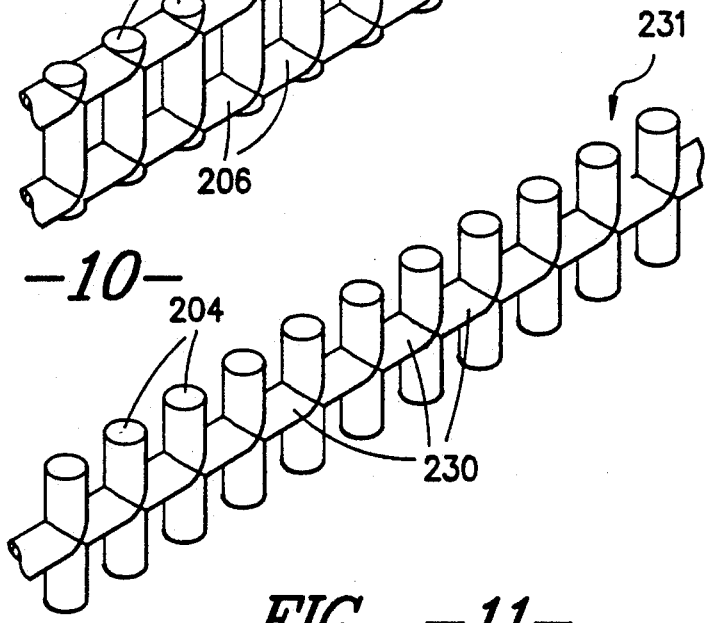
FIG. 11 is an isolated perspective view of a cross-type chain belt.

A fourth embodiment of the first or second endless belt 68, 69 is to use a series of cylindrical members 204 similar to that found in the previous embodiment that are interconnected by a single series of perpendicular linking members 230 located near the middle of the series of cylindrical members 204 as shown in FIG. 11. This cross-type chain is generally indicated by numeral 231.

It is not intended that the scope of the invention be limited to the specific embodiment illustrated and described. Rather, it is intended that the scope of the invention be defined by the appended claims and their equivalents.

What is claimed is:

1. An apparatus for forming a scrim, having an outer perimeter, with yarns oriented in the bias direction comprising:

(a) a plate means having a longitudinal axis and a first end portion and a second end portion;
(b) a first endless belt;
(c) a second endless belt;
(d) a first drive means for rotating said first endless belt in a first direction and rotating said second endless belt in a second direction opposite said first direction;
(e) means for feeding a plurality of yarns to the plate means; and
(f) a first attachment means for transversely attaching said first drive means to said plate means, wherein said scrim is formed by encircling said plate means, said first endless belt and said second endless belt by the plurality of yarns, with yarns oriented in a bias angle with respect to said longitudinal axis and said outer perimeter of said scrim is substantially constant throughout said longitudinal axis, wherein said scrim is transported by said first endless belt and said second endless belt in a direction parallel to said longitudinal axis of said plate means.

2. An apparatus for forming a scrim, having an outer perimeter, with yarns oriented in the bias direction comprising:

(a) a plate means having a longitudinal axis and a first end portion and a second end portion;
(b) a first endless belt;
(c) a second endless belt;
(d) a first drive means for rotating said first endless belt in a first direction and said second endless belt in a second direction opposite said first direction;
(e) a second drive means for transporting said scrim in a direction parallel to the longitudinal axis of said plate means;
(f) means for feeding a plurality of yarns to the plate means; and
(g) a first attachment means for transversely attaching said first drive means to said plate means; and
(h) a second attachment means for transversely attaching said second drive means to said plate means, wherein said scrim is formed by encircling said plate means, said first endless belt and said second endless belt by the plurality of yarns, with yarns oriented in a bias angle with respect to said longitudinal axis and said outer perimeter of said scrim is substantially constant throughout said longitudinal axis, wherein said scrim is transported by said first endless belt and said second endless belt in a direction paralle to said longitudinal axis of said plate means.

3. The apparatus according to claim 1, wherein said first drive means includes a first rotatable member operatively engaging said first endless belt and a means for attaching said first rotatable member to said plate means and a second rotatable member operatively engaging said first endless belt and means for attaching said second rotatable member to said plate means and a third rotatable member operatively engaging said second endless belt and means for attaching said third rotatable member to said plate means and a fourth rotatable member operatively engaging said second endless belt and means for attaching said fourth rotatable member to said plate means and a means for rotating said first rotatable member and said third rotatable member.

4. An apparatus for forming a scrim with yarns oriented in the bias direction comprising:

(a) a plate means having a longitudinal axis and a first end portion and a second end portion;
(b) a first endless belt;
(c) a second endless belt;
(d) means for feeding a plurality of yarns to the plate means; and
(e) a first drive means for rotating said first endless belt in a first direction and rotating said second endless belt in a second direction opposite said first direction, wherein said first drive means includes a first rotatable member operatively engaging said first endless belt and a means for attaching said first rotatable member to said plate means and a second rotatable member operatively engaging said first endless belt and means for attaching said second rotatable member to said plate means and a third rotatable member operatively engaging said second endless belt and means for attaching said third rotatable member to said plate means and a fourth rotatable member operatively engaging said second endless belt and means for attaching said fourth rotatable member to said plate means and a means for rotating said first rotatable member and said third rotatable member, wherein said means for rotating said first rotatable member and said third rotatable member includes a fifth member fixedly attached to said first rotatable member and a sixth rotatable member and a seventh member fixedly attached to said sixth rotatable member and a means for attaching said sixth rotatable member to said plate means and a first secondary drive belt and wherein said fifth member and said seventh member operatively engage said first secondary drive belt and an eighth member fixedly attached to said third rotatable member and a ninth rotatable member and a tenth member fixedly attached to said ninth rotatable member and a means for attaching said ninth rotatable member to said plate means and a second secondary drive belt wherein said eighth member and said tenth member operatively engage said second secondary drive belt and means for rotating said sixth rotatable member and said ninth rotatable member; and (f) a first attachment means for transversely attaching said first drive means to said plate means, wherein said scrim is formed by encircling said plate means, said first endless belt and said second endless belt by the plurality of yarns; wherein said scrim is transported by said first endless belt and said second endless belt in a direction parallel to said longitudinal axis of said plate means.

5. The apparatus according to claim 4, wherein said means for rotating said sixth rotatable member and said ninth rotatable member includes a rotatable shaft and a means for rotatably attaching said rotatable shaft to said plate means and a frictional engagement means fixedly attached to said rotatable shaft whereby said frictional engagement means is adjacent said sixth rotatable member and said ninth rotatable member.

6. The apparatus according to claim 5, wherein said first rotatable member includes a sprocket and said second rotatable member includes a sprocket and said third rotatable member includes a sprocket and said fourth rotatable member includes a sprocket.

7. The apparatus according to claim 6, wherein said fifth rotatable member includes a sprocket and said seventh rotatable member includes a sprocket and said sixth rotatable member includes a worm wheel and said eighth rotatable member includes a sprocket and said tenth rotatable member includes a sprocket and said ninth rotatable member is a worm wheel.

8. The apparatus according to claim 7, wherein said means for rotatably attaching said rotatable shaft to said plate means includes a plurality of bearings and said frictional engagement means includes a worm gear.

9. The apparatus according to claim 1, wherein said plate means includes a plurality of plate members each having a longitudinal axis with a plurality of support members transverse to said plate members and attached thereto.

10. The apparatus according to claim 1, further comprising a first support member located interposed within said first endless belt and a second support member located interposed within said second endless belt and a means for transversely attaching said first support member to said plate means and a means for transversely attaching said second support member to said plate means.

11. The apparatus according to claim 1, further comprising a spread plate means attached to said second end portion of said plate means.

12. The apparatus according to claim 11, wherein said spread plate means includes a first rotatable member rotatably attached to said spread plate means and a second rotatable member rotatably attached to said spread plate means.

13. The apparatus according to claim 11, wherein said spread plate means includes a plurality of rotatable members rotatably attached thereto.

14. The apparatus according to claim 12, wherein said first rotatable member includes a gear and said second rotatable member includes a gear.

15. The apparatus according to claim 13, wherein said rotatable members include gears.

16. The apparatus according to claim 1, wherein said first drive means includes a first rotatable member operatively engaging said first endless belt and a means for attaching said first rotatable member to said plate means and a second rotatable member operatively engaging said first endless belt and means for attaching said second rotatable member to said plate means and a third rotatable member operatively engaging said second endless belt and means for attaching said third rotatable member to said plate means and a fourth rotatable member operatively engaging said second endless belt and means for attaching said fourth rotatable member to said plate means and a means for rotating said first endless belt and said second endless belt.

17. An apparatus for forming a scrim with yarns oriented in the bias direction comprising:

(a) a plate means having a longitudinal axis and a first end portion and a second end portion;

(b) a first endless belt;

(c) a second endless belt;

(d) means for feeding a plurality of yarns to the plate means;

(e) a first drive means for rotating said first endless belt in a first direction and rotating said second endless belt in a second direction opposite said first direction, wherein said first drive means includes a first rotatable member operatively engaging said first endless belt and a means for attaching said first rotatable member to said plate means and a second rotatable member operatively engaging said first endless belt and means for attaching said second rotatable member to said plate means and a third rotatable member operatively engaging said second endless belt and means for attaching said third rotatable member to said plate means and a fourth rotatable member operatively engaging said second endless belt and means for attaching said fourth rotatable member to said plate means and a means for rotating said first endless belt and said second endless belt, wherein said means for rotating said first endless belt and said second endless belt includes a fifth rotatable member in frictional contact with said first endless belt and a sixth rotatable member in firctional contact with said second endless belt and a means for rotating said fifth rotatable member and said sixth rotatable member; and (f) a first attachment means for transversely attaching said first drive means to said plate means, wherein said scrim is formed by encircling said plate means, said first endless belt and said second endless belt by the plurality of yarns, wherein said scrim is transported by said first endless belt and said second endless belt in a direction parallel to said longitudinal axis of said plate means.

18. The apparatus according to claim 17, wherein said means for rotating said fifth rotatable member and said sixth rotatable member includes a first drive transmission attached to said fifth rotatable member and a second drive transmission attached to said sixth rotatable member and a drive shaft connected to said first drive transmission and said second drive transmission.

19. The apparatus according to claim 18, wherein said fifth rotatable member includes a sprocket and said sixth rotatable member includes a sprocket.

20. The apparatus according to claim 12, further comprising a means for rotating said first rotatable member and said second rotatable member.

21. An apparatus for forming a scrim with yarns oriented in the bias direction comprising:

(a) a plate means having a longitudinal axis and a first end portion and a second end portion;

(b) a first endless belt;

(c) a second endless belt;

(d) means for feeding a plurality of yarns to the plate means;

(e) a first drive means for rotating said first endless belt in a first direction and rotating said second endless belt in a second direction opposite said first direction;

(f) a first attachment means for transversely attaching said first dirve means to said plate means, wherein said scrim is formed by encircling said plate means, said first endless belt and said second endless belt by the plurality of yarns, wherein said scrim is transported by said first endless belt and said second endless belt in a direction parallel to said longitudinal axis of said plate means and further comprising a spread plate means attached to said second end portion of said plate means wherein said spread plate means includes a first rotatable member rotatably attached to said spread plate means and a second rotatable member rotatably attached to said spread plate means and further comprising a means for rotating said first rotatable member and said second rotatable member wherein said means for rotating said first rotatable member and said second rotatable member includes a fifth rotatable member in frictional contact with said first rotatable member and a sixth rotatable member in firctional contact with said second rotatable member and a means for rotating said fifth rotatable member and said sixth rotatable member.

22. The apparatus according to claim 21, wherein said means for rotating said fifth rotatable member and said sixth rotatable member includes first drive transmission attached to said fifth rotatable member and a second drive transmission attached to said fifth rotatable member and a drive shaft connected to said first drive transmission and said second drive transmission.

23. The apparatus according to claim 22, wherein said fifth rotatable member includes a sprocket and said sixth rotatable member includes a sprocket.

24. The apparatus according to claim 1, wherein said first endless belt is substantially flat and said second endless belt is substantially flat.

25. An apparatus for forming a scrim with yarns oriented in the bias direction comprising:

(a) a plate means having a longitudinal axis and a first end portion and a second end portion;

(b) a first endless belt, wherein said first endless belt is substantially flat with a plurality of cylindrical protrusions thereon;

(c) a second endless belt; wherein said second endless belt is substantially flat with a plurality of cylindrical protrusions thereon;

(d) means for feeding a plurality of yarns to the plate means; and (e) a first drive means for rotating said first endless belt in a first direction and rotating said second endless belt in a second direction opposite said first direction; and (f) a first attachment means for transversely attaching said first drive means to said plate means, wherein said scrim is formed by encircling said plate means, said first endless belt and said second endless belt by the plurality of yarns, wherein said scrim is transported by said first endless belt and said second endless belt in a direction parallel to said longitudinal axis of said plate means.

26. An apparatus for forming a scrim with yarns oriented in the bias direction comprising:

(a) a plate means having a longitudinal axis and a first end portion and a second end portion;

(b) a first endless belt, wherein said first endless belt includes a plurality of cylinders each having a first end portion, middle portion and a second end portion and interlinked at the first end portions by linking members and interlinked at said second end portions by linking members to form a ladder-type chain;

(c) a second endless belt; wherein said second endless belt includes a plurality of cylinders each having a first end portion, middle portion and a second end portion and interlinked at the first end portions by linking members and interlinked at said second end portions by linking members to form a ladder-type chain;

(d) means for feeding a plurality of yarns to the plate means; and (f) a first attachment means for transversely attaching said first drive means to said plate means, wherein said scrim is formed by encircling said plate means, said first endless belt and said second endless belt by the plurality of yarns, wherein said scrim is transported by said first endless belt and said second endless belt in a direction parallel to said longitudinal axis of said plate means.

27. An apparatus for forming a scrim with yarns oriented in the bias direction comprising:

(a) a plate means having a longitudinal axis and a first end portion and a second end portion;

(b) a first endless belt, wherein said first endless belt includes a plurality of cylinders each having a first end portion, middle portion and a second end portion and interlinked at said middle portions by linking members to form a cross-type chain;

(c) a second endless belt; wherein said second endless belt includes a plurality of cylinders each having a first end portion, middle portion and a second end portion and interlinked at said middle portions by linking members to form a cross-type chain;

(d) means for feeding a plurality of yarns to the plate means; and (e) a first drive means for rotating said first endless belt in a first direction and rotating said second endless belt in a second direction opposite said first direction; and (f) a first attachment means for transversely attaching said first drive means to said plate means, wherein said scrim is formed by encircling said plate means, said first endless belt and said second endless belt by the plurality of yarns, wherein said scrim is transported by said first endless belt and said second endless belt in a direction parallel to said longitudinal axis of said plate means.

28. A process for forming a scrim, having an outer perimeter, with yarns oriented in a bias direction from a plurality of rotated yarns comprising:

engaging and transporting said rotated yarns with a first endless belt rotatable in a first direction and simultaneously engaging and transporting said rotated yarns with a second endless belt rotatable in a second direction opposite to said first direction, thereby forming said scrim while moving said rotated yarns over a plate means having a first end portion, second end portion, and a longitudinal axis, with said rotated yarns oriented in a bias angle with respect to said longitudinal axis and said outer perimeter of said scrim is substantially constant throughout said longitudinal axis.

29. A process for forming a scrim, having an outer perimeter, with yarns oriented in a bias direction from a plurality of rotated yarns comprising:

(a) engaging and transporting said rotated yarns with a first endless belt rotatable in a first direction and simultaneously engaging and transporting said rotated yarns with a second endless belt rotatable in a second direction opposite to said first direction, thereby forming a scrim while moving said rotated yarns over said plate means having a first end portion, second end portion, and a longitudinal axis, with said rotated yarns oriented in a bias angle with respect to said longitudinal axis and said outer perimeter of said scrim is substantially constant throughout said longitudinal axis; and (b) transporting said rotated yarns over a plurality of rotatable gears rotatably attached to a spread plate, wherein said spread plate is attached to said second end portion of said plate means.

30. A process for forming a scrim, having an outer perimeter, with yarns oriented in a bias direction from a plurality of rotataed yarns comprising:

(a) engaging and transporting said rotated yarns with a first endless belt rotatable in a first direction and simultaneously engaging and transporting said rotated yarns with a second endless belt rotatable in a second direction opposite to said first direction, thereby forming a scrim while moving said rotated yarns over said plate means having a first end portion, second end portion, and a longitudinal axis, with said rotated yarns oriented in a bias angle with respect to said longitudinal axis and said outer perimeter of said scrim is substantially constant throughout said longitudinal axis;

(b) transporting said rotated yarns over a plurality of rotatable gears rotatably attached to a spread plate, wherein said spread plate is attached to said second end portion of said plate means;

(c) compressing said rotated yarns;

(d) applying adhesive to said rotated yarns; and (e) drying said adhesive.

31. A process for forming a scrim, having an outer perimeter, with yarns oriented in a bias direction from a plurality of rotated yarns comprising:

(a) engaging and transporting said rotated yarns with a first endless belt rotatable in a first direction by means of a first rotatable sprocket rotatably attached to a first drive transmission that is operatively connected to a drive shaft and simultaneously engaging and transporting said rotated yarns with a second endless belt rotatable in a second direction opposite to said first direction by means of a second rotatable sprocket rotatably attached to a second drive transmission that is operatively connected to said drive shaft, thereby forming said scrim while moving said rotated yarns over a plurality of plates each having a longitudinal axis and support means transverse to said plates and attached thereto, with said rotated yarns oriented in a bias angle with respect to each said longitudinal axis of said plurality of plates and said outer perimeter of said scrim is substantially constant throughout each said longitudinal axis of said plurality of plates.

32. A process for for forming a scrim, having an outer perimeter, with yarns oriented in a bias direction from a plurality of rotated yarns comprising:

(a) engaging and transporting said rotated yarns with a first endless belt rotatable in a first direction and simultaneously engaging and transporting said rotated yarns with a second endless belt rotatable in a second direction opposite to said first direction, thereby forming said scrim while moving said rotated yarns over a plate means having a first end portion, second end portion, and a longitudinal axis, with said rotated yarns oriented in a bias angle with respect to said longitudinal axis and said outer perimeter of said scrim is substantially constant throughout said longitudinal axis; and (b) transporting said rotated yarns over a first rotatable gear rotatably attached to a spread plate that is rotated by means of a first rotatable sprocket rotatably attached to a first drive transmission that is operatively connected to a drive shaft and a second rotatable gear rotatably attached to a second drive transmission that is operatively connected to said drive shaft, wherein said spread plate is attached to said second end portion of said plate means.

33. A process for forming a scrim, having an outer perimeter, with yarns oriented in a bias direction from a plurality of rotated yarns comprising:

engaging and transporting said rotated yarns with a first endless belt rotatable in a first direction by mans of a first rotatable member operatively engaging said first endless belt attached to said plate means and a second rotatable member operatively engaging said first endless belt and attached to said plate means and simultaneously engaging and transporting said rotated yarns with a second endless belt rotatable in a second direction opposite to said first directon by means of a third rotatable member operatively engaging said second endless belt and attached to said plate means and a fourth rotatable member operatively engaging said second endless belt and attached to said plate means and a means for rotating said first rotatable member and said third rotatable member, thereby forming said scrim while moving said rotated yarns over a plate means having a first end portion, second end portion, and a longitudinal axis, with said rotated yarns oriented in a bias angle with respect to said longitudinal axis and said outer perimeter of said scrim is substantially constant throughout said longitudinal axis.

34. A process for forming a scrim, having an outer perimeter, with yarns oriented in a bias direction from a plurality of rotated yarns comprising:

engaging and transporting said rotated yarns with a first endless belt rotatable in a first direction by means of a first rotatable member operatively engaging said first endless belt attached to said plate means and a second rotatable member operatively engaging said first endless belt and attached to said plate means and simultaneously engaging and transporting said rotated yarns with a second endless belt rotatable in a second direction opposite to said first direction by means of a third rotatable member operatively engaging said second endless belt and attached to said plate means and a fourth rotatable member operatively engaging said second endless belt and attached to said plate means and a means for rotating said first rotatable member and said third rotatable member which includes a fifth member fixedly attached to said first rotatable member and a sixth rotatable member and a seventh member fixedly attached to said sixth rotatable membner and sixth rotatable member is attached to said plate means and a first secondary drive belt and wherein said fifth member and said seventh member operatively engage said first secondary drive belt and eighth member fixedly attached to said third rotatable member and a ninth rotatably member and a tenth member fixedly attached to said ninth rotatable member attached to said plate means and a second secondary drive belt wherein said eighth member and said tenth member operatively engage said second secondary drive belt and means for rotating said sixth rotatable member and said ninth rotatable member, thereby forming said scrim while moving said rotated yarns over a plate means having a first end portion, second end portion, and a longitudinal axis, with said rotated yarns oriented in a bias angle with respect to said longitudinal axis and said outer perimeter of said scrim is substantially constant throughout said longitudinal axis.

35. A process for forming a scrim, having an outer perimeter, with yarns oriented in a bias direction from a plurality of rotated yarns comprising:

engaging and transporting said rotated yarns with a first endless belt rotatable in a first direction by means of a first rotatable member operatively engaging said first endless belt attached to a plate means and a second rotatable member operatively engaging said first endless belt and attached to said plate means and simultaneously engaging and transporting said rotated yarns with a second endless belt rotatable in a second direction opposite to said first direction by means of a third rotatable member operatively engaging said second endless belt and attached to said plate means and a fourth rotatable member operatively engaging said second endless belt and attached to said plate means and a means for rotating said first rotatable sprocket and said third rotatable sprocket which includes a fifth rotatable sprocket fixedly attached to said first rotatable sprocket and a sixth rotatable worm gear and a seventh rotatable sprocket fixedly attached to said sixth rotatable worm gear and said sixth rotatable worm gear is rotatably attached to said plate means and a first secondary drive belt and wherein said fifth rotatable sprocket and said seventh rotatable sprocket operatively engage said first secondary drive belt and a eighth rotatable sprocket fixedly attached to said third rotatable sprocket and a ninth rotatable worm gear and a tenth rotatable sprocket fixedly attached to said ninth rotatable worm gear rotatably attached to said plate means and a second secondary drive belt wherein said eighth rotatable sprocket and said tenth rotatable sprocket operatively engage said second secondary drive belt and means for rotating said sixth worm gear and said ninth worm gear includes a worm gear fixedly attached to a rotatable shaft, thereby forming said scrim while moving said rotated yarns over said plate means having a longitudinal axis, with said rotated yarns oriented in a bias angle with respect to said longitudinal axis of said plate means and said outer perimeter of said scrim is substantially constant throughout each said longitudinal axis of said plate means.

* * * * *